US006493971B1

(12) United States Patent
Yuen

(10) Patent No.: US 6,493,971 B1
(45) Date of Patent: Dec. 17, 2002

(54) DISPLAY APPARATUS FOR AQUATIC TOY ANIMALS

(76) Inventor: Wang Sing Yuen, 11/F Flat D Block 2, Tai Ping Ind., Centre 55 Ting Kok Rd., Tai Po (HK)

( * ) Notice: Subject to any disclaimer, the term of this patent is extended or adjusted under 35 U.S.C. 154(b) by 27 days.

(21) Appl. No.: 09/712,245

(22) Filed: Nov. 15, 2000

Related U.S. Application Data

(60) Provisional application No. 60/194,364, filed on Apr. 4, 2000.

(51) Int. Cl.[7] ..... G09F 19/00
(52) U.S. Cl. ..... 40/426; 40/406; 40/414
(58) Field of Search ..... 40/406, 409, 412, 40/414, 415, 426; 273/456; 446/131, 133, 134, 135, 136, 267

(56) References Cited

U.S. PATENT DOCUMENTS

| | | | | |
|---|---|---|---|---|
| 1,595,801 A | | 8/1926 | McDonald | |
| 3,006,111 A | | 10/1961 | Koch | |
| 3,239,956 A | * | 3/1966 | Canonica, Jr. | 40/426 |
| 3,425,157 A | | 2/1969 | Hartsock | |
| 3,535,805 A | * | 10/1970 | Peiperl | 40/406 |
| 4,490,931 A | * | 1/1985 | Fleemin | 40/406 |
| 4,757,986 A | | 7/1988 | Hwang et al. | |
| 4,852,283 A | | 8/1989 | Jeng | |
| 5,050,876 A | | 9/1991 | Chuang | |
| 5,146,701 A | | 9/1992 | Lee | |
| 5,272,604 A | * | 12/1993 | Lin | 40/409 X |
| 5,301,444 A | | 4/1994 | Horiuchi | |
| 5,313,727 A | * | 5/1994 | Murray, Jr. | 40/410 |
| 5,405,465 A | | 4/1995 | Horiuchi | |
| 5,463,826 A | * | 11/1995 | Horiuchi | 40/426 |
| 5,603,994 A | | 2/1997 | Su | |
| 6,282,820 B1 | * | 9/2001 | White et al. | 40/426 X |
| 6,332,282 B1 | * | 12/2001 | Lin | 40/406 |
| 6,357,151 B1 | * | 3/2002 | Yuen | 40/406 |

FOREIGN PATENT DOCUMENTS

DE P12239X1/77 f 2/1957

* cited by examiner

*Primary Examiner*—Brian K. Green
(74) *Attorney, Agent, or Firm*—Shlesinger, Arkwright & Garvey LLP

(57) ABSTRACT

This device relates to a fluid display apparatus for an aquatic toy figure such as a fish, turtle or other marine animal or the. like. The base mount supports a receptacle having fluid therein and at least one toy aquatic piece. A motor drives a magnetic impeller in the base which in turn drives a magnetic impeller in the receptacle which causes agitation of the fluid in the receptacle to cause the aquatic toy animal to move in a realistic fashion.

14 Claims, 4 Drawing Sheets

DISPLAY APPARATUS FOR AQUATIC TOY ANIMALS

This application is based on provisional application Ser. No. 60/194,364 filed: Apr. 4, 2000.

FIELD OF INVENTION

This invention relates to a fish bowl or the like which will contain at least one toy aquatic figure which has a specific gravity approximating that of the fluid in which the figure is placed. A magnetically driven system will agitate the fluid to cause the animal in the fluid to swim in a realistic manner. This invention is unique in that the impeller mechanism for agitating the fluid is positioned within the display receptacle or bowl which is separatable from the base and not connected thereto.

BACKGROUND OF THE INVENTION

Fluid display apparatus for fish and other aquatic animals are shown in U.S. Pat. Nos. 5,301,444, 5,405,465, 5,050,876, 5,603,994, 1,595,801, 3,425,157 and German Patent Patentanmeldung of Nov. 10, 1955 P12,239 XI-77f. In these patents, the animal has attached thereto a magnet which is affected by a second magnet which passes by the first magnet either by manual or motor means.

Some similar magnetic driving devices are shown in U.S. Pat. Nos. 4,757,986, 4,852,283, 3,006,111 and 5,146,701. In these patents, the animal figure responds through a magnetic field. In the case of U.S. Pat. No. 5,146,701, the container is moved by a magnetic field. In the case of U.S. Pat. No. 3,006,111, a magnetic field causes movement of the figure which is not encased or otherwise positioned in a fluid receptacle. In the case of U.S. Pat. No. 4,757,986, the magnets drive a figure rotationally on a non-moving platform. In the case of U.S. Pat. No. 4,852,283, the moving device can stir the debris of articles in the fluid to cause them to move about to mimic a rain or snow fall.

OBJECTS AND SUMMARY OF THE INVENTION

It is an object of this invention to provide a mechanism within a tank, bowl or receptacle which will agitate the fluid so as to cause an aquatic toy animal or the like to move with the fluid current.

Another object of this invention is to provide an aquatic display device which has a tank which is removable and separate from the base upon which it sets and is not glued or otherwise secured thereto. This allows for washing of the receptacle periodically when the fluid therein discolors.

Still another object of this invention is to provide a rotating mechanism within the tank which will agitate the fluid in various directions so as to cause the aquatic toy animal or the like to move realistically in the tank or bowl.

Yet another object of this invention is to provide an aquatic toy animal display apparatus which is inexpensive to manufacture.

Still another object of this invention is to provide an aquatic display apparatus which includes an impeller which agitates the fluid which can also be removed from the tank for cleaning and the like.

A further object of this invention is to provide a base platform which does not have to be sealed from the fluid which is in the tank.

In summary, this invention relates to aquatic toy animals positioned in a tank, receptacle or the like which are influenced by the motion of the fluid therein.

These and other objects of this invention will be apparent from the following detailed description including the drawings which are as follows:

DETAILED DESCRIPTION OF THE INVENTION

FIGURE 1

Figure 1:
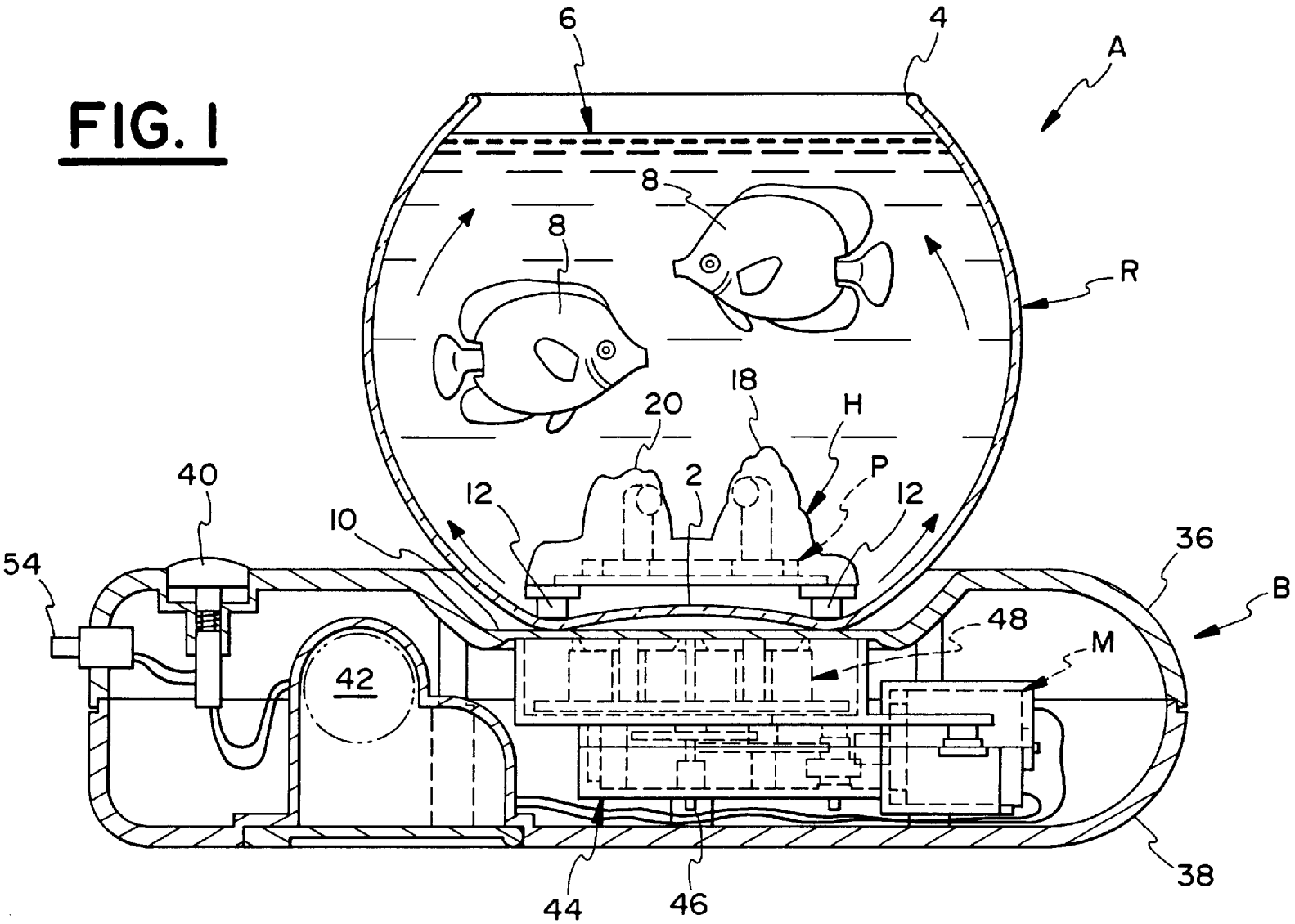
FIG. 1 is a cross sectional view of the apparatus.
Figure 2:
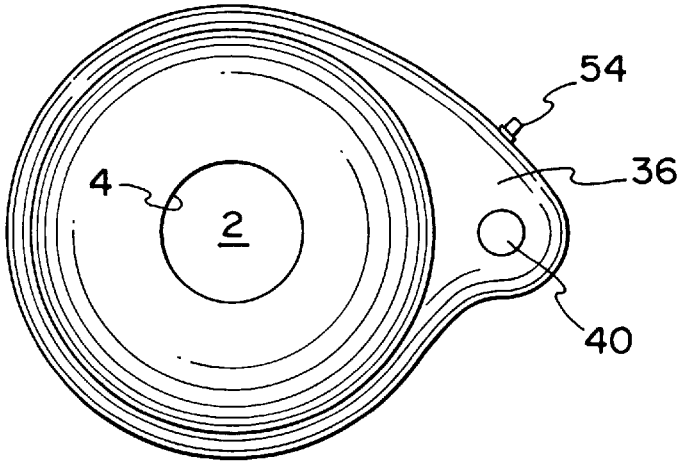
FIG. 2 is a top plan view of the apparatus.
Figure 3:
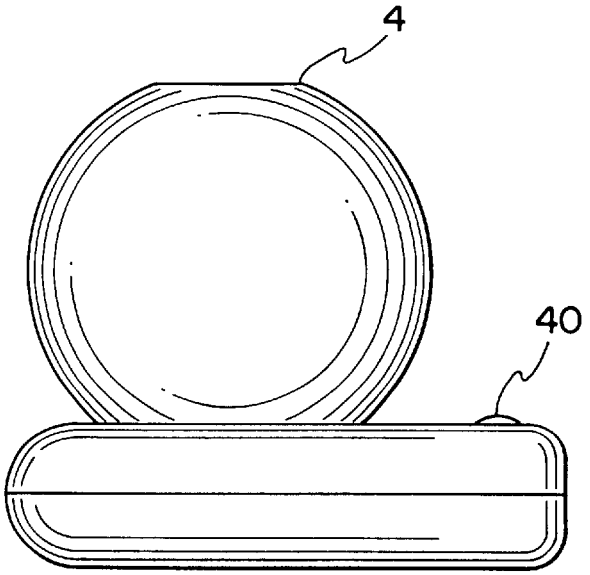
FIG. 3 is a side elevational view of the apparatus.
Figure 4:
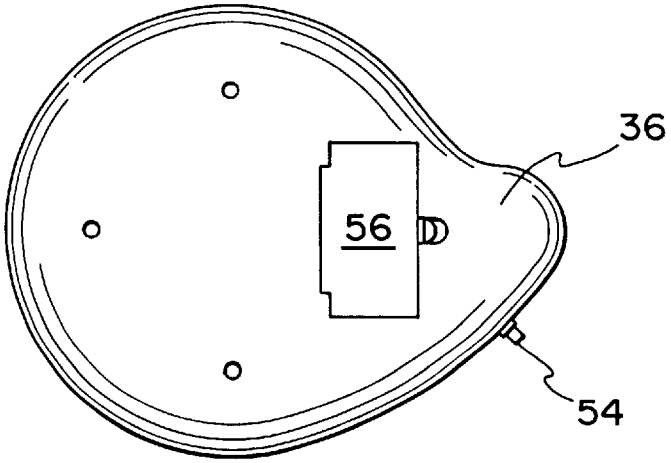
FIG. 4 is a bottom plan view of the apparatus.

FIG. 1, the apparatus A includes a base B and a receptacle, bowl or tank R. The receptacle R is closed at the bottom 2 and open at the top 4. The receptacle R is transparent and made of plastic or glass and is filled with colorless fluid, preferably water 6.

As shown in FIG. 1, a receptacle R holds simulated aquatic toy fish 8 which are of a specific gravity substantially the same as the fluid 6. Under non-operating conditions, the simulated toy fish 8 would rest at the bottom 2 of the receptacle R, and upon agitation of the fluid 6, the simulated toy fish 8 will move about and receptacle R in a life-like fashion simulating real fish. The simulated toy fish or animals or the like 8 are non-magnetic and can be fashioned from plastic, glass or other materials having a specific gravity similar to that of the fluid 6, or the materials from which they are made might be heavier and the specific gravity of the fluid requiring an air chamber to effectively produce a simulated toy fish 8 which does have a specific gravity similar to that of the fluid 6.

For cleaning purposes, a receptacle, bowl or tank R can be lifted from the base B and cleaned and washed and filled with fluid 6 as desired. The receptacle R is unattached to the base B and rests thereon in a base recess 10. It should be noted in FIG. 1 that the bottom 2 of the receptacle R is somewhat concaved. This concavity of the bottom 2 is preferred but not absolutely essential. The concavity of the bottom 2 aids in positioning of the housing H. The housing H includes pads or feet 12 which rest on the bottom at the ends of the concavity of the bottom 2 for ready positioning. A pressure sensitive adhesive may be applied to the pads 12 to secure the housing H to the bottom 2. For cleaning purposes, the housing H may be readily removed from the receptacle R.

Figure 7:
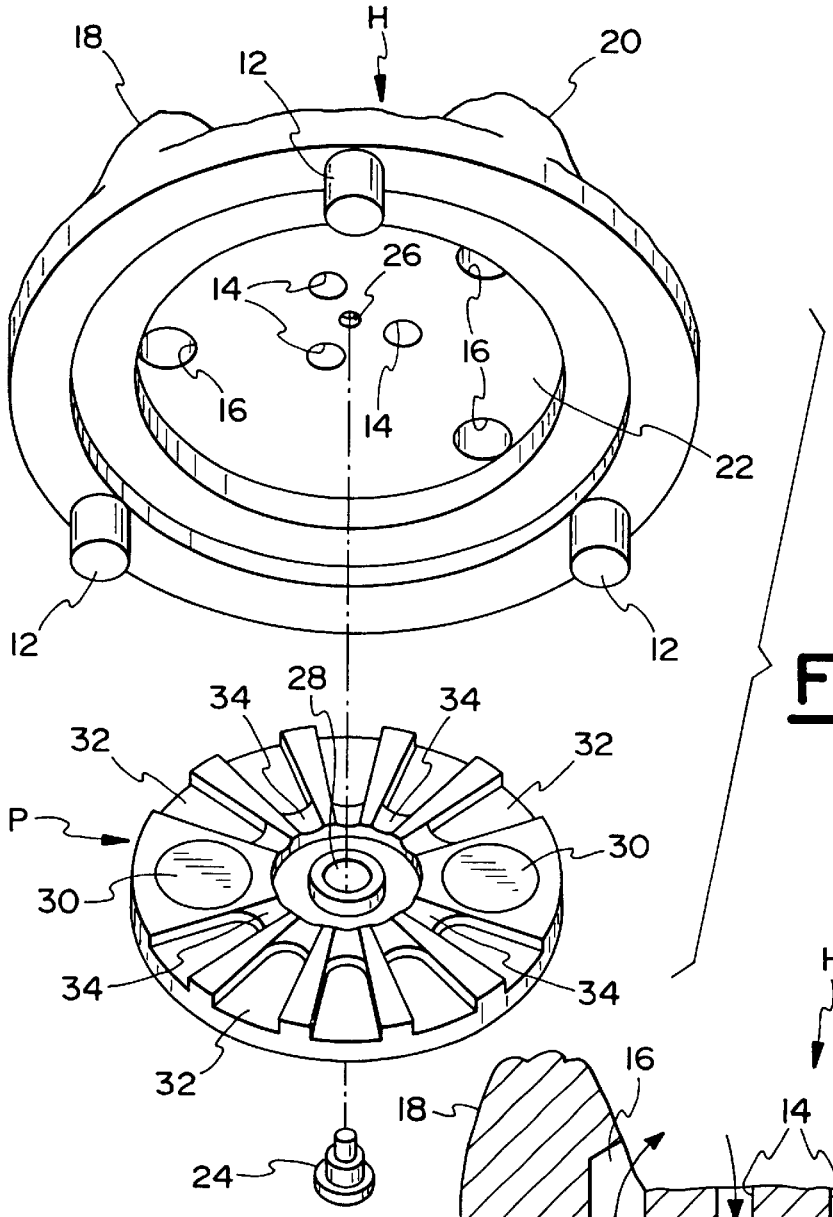
FIG. 7 is an exploded view of the housing and impeller mechanism which is positioned in the receptacle bowl or tank.
Figure 8:
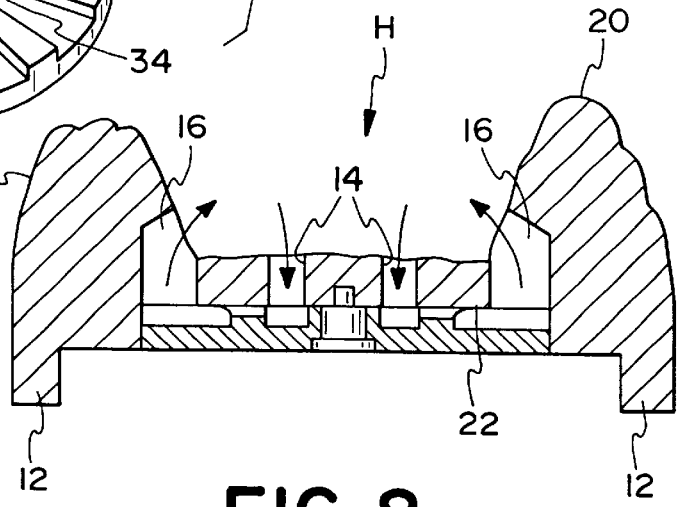
FIG. 8 is an enlarged cross sectional view of the impeller mechanism shown in FIG. 7.

As best shown in FIGS. 7 and 8, the housing H is provided with inlet orifices or perforations 14 or outlet orifices or perforations 16. The outlet orifices 16 may be positioned in the housing H so as to direct the fluid 6 in an inward angular direction as shown by the arrows in the FIG. 8. The inlet perforations 14 and the outlet perforations 16 may be placed in a scenic environment molded into the housing H which scenes might include sea mounts 18 and 20. The housing H includes a recess 22 for receiving a rotatable impeller P. The impeller P rotates around an axle pin 24 which is inserted into the pin receiving opening 26 (FIG. 7). The axle pin 24 extends thought the impeller sleeve 28.

The impeller P, as best shown in FIG. 7, has magnetic members 30 mounted therein. Radially disposed about the impeller P are flutes 32 which include a flute step 34. The flutes 32 including the flute steps 34 are radially disposed about the impeller P. When the impeller P is driven, the fluid 6 coming through the inlet orifices or perforations 14 is thrown outwardly and exits the outlet orifices or perforations 16 or under the housing H and around the pads or feet 12. It will be obvious that at least one inlet orifice 14 is necessary to bring water or fluid 6 into the impeller P, although the outlet orifices 16 are preferred. Agitation of the fluid will occur when the impellers pushes the water 6 out under the housing H around the pads or feet 12. The impeller P should not fit tightly against-the recess 22. It further spins freely about the axle pin 24.

Figure 5:
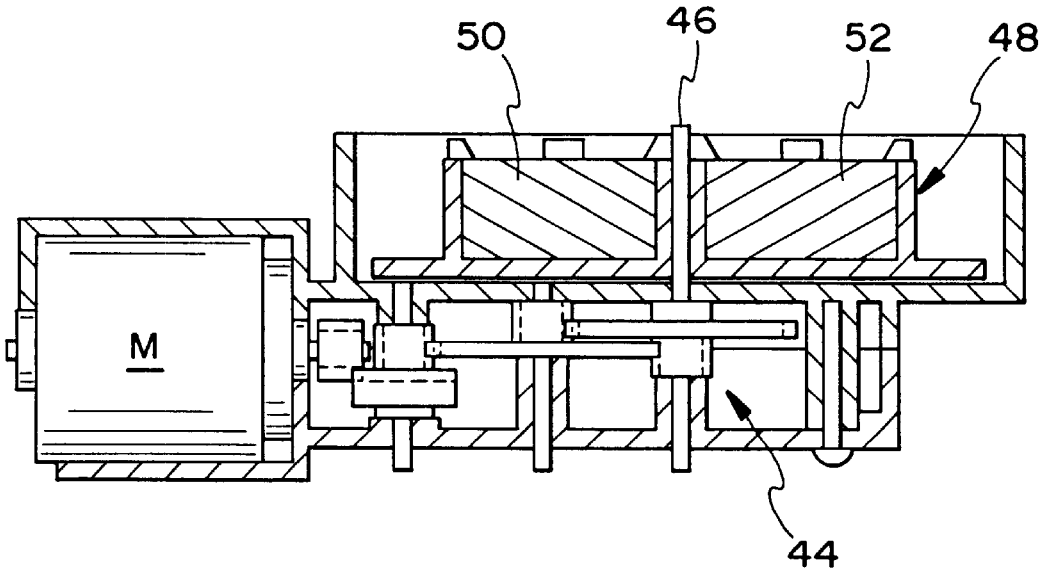
FIG. 5 is an enlarged cross sectional view of the motor drive mechanism as removed from the base.
Figure 6:
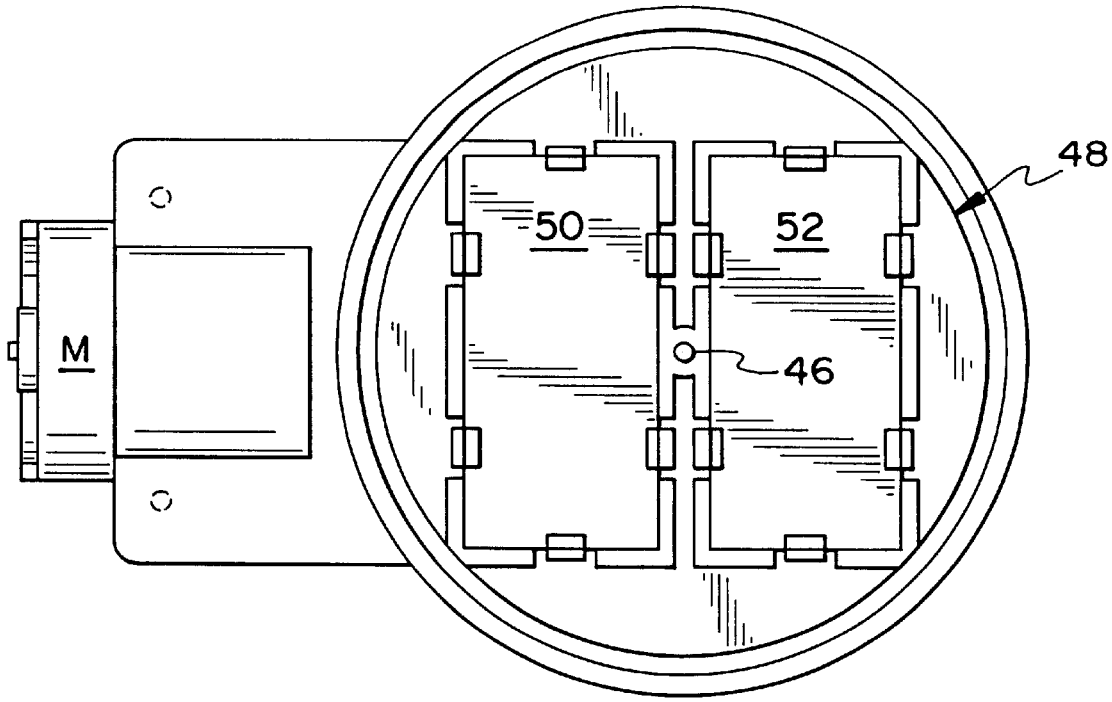
FIG. 6 is a top plan view of the motor drive mechanism of FIG. 5.

The base B is formed of two halves; namely the upper half 36 and the lower half 38. The upper half 36 includes a button switch 40 connected to a battery or other electrical power source 42 which in turn is connected to a motor M. The motor M is connected to a drive train or speed reduction gearing 44 generally shown in FIG. 5. A drive shaft 46 from the drive train or speed reduction gearing 44 drives a first impeller 48 having positioned thereon magnetic member 50 and 52. The magnetic members 50 and 52 rotate about the drive shaft 46 when the motor M is turned on by pushing the button switch 40. A rheostat control 54 may be positioned on the base B for adjusting the speed of the first impeller 48.

In the base B in the bottom half 38, a door 56 for the battery 42 is provided for replacing the battery 42 as required.

OPERATION

In operation, the first impeller 48 upon rotation will cause the impeller P to move due to the magnetic influence of the magnetic members 50 and 52 of the first impeller 48 on the magnets 30 of the impeller P. Rotation of the impeller P draws fluid into the orifices or perforations 14 and projects it by means of the flutes 32 and flutes steps 34 outwardly toward the outlet orifices 16 as well as under the impeller P out the recess 22 and around the pads or feet 12. This movement of the fluid 6 stirs up the fluid 6 causing the simulated toy animal such as the fish 8 to swim about the receptacle R. As mentioned earlier removal of the receptacle R as well as the housing H can be accomplished without damage to the base B which houses the motor M and the drive train mechanism 44 and impeller 48.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

What is claimed is:

1. A fluid display apparatus for an aquatic toy figure and simulating swimming movements comprising:

a) a base having a top, bottom and sides;

b) said base having receptacle receiving means;

c) a fluid receiving receptacle receivable on said receptacle receiving means and separable therefrom having a top and a bottom;

d) said base having a motor and a power source for said motor;

e) said motor having an on/off switch;

f) a first magnetic impeller mounted in said base and driven by said motor;

g) a second magnetic impeller mountable in said fluid receiving receptacle and driven by said first magnetic impeller and having a top and a bottom;

h) a housing for said second magnetic impeller mountable on said fluid receiving receptacle bottom and having a top and bottom;

i) an aquatic toy positionable in said receptacle having a specific gravity substantially that of the fluid received in said receptacle;

j) said housing being perforated;

k) said first and second magnetic impellers each including at least one pocket;

l) said at least one pocket of said first and second magnetic impellers supporting a magnet;

m) said second magnetic impeller is fluted radially;

n) whereby said aquatic toy figure will be caused to simulate swimming by agitation of said fluid placed in said receptacle when second magnetic impeller is driven by said first magnetic impeller when said motor is turned on when said on/off switch is turned on.

2. A fluid display apparatus as in claim 1 and wherein:

a) said radial fluting is stepped.

3. A fluid display apparatus as in claim 2 and wherein:

a) said radial fluting is on the top of said second magnetic impeller.

4. A fluid display apparatus as in claim 3 and wherein:

a) said housing for said second magnetic impeller includes pads for supporting said housing in said fluid receiving receptacle.

5. A fluid display apparatus as in claim 4 wherein:

a) said housing has a bottom recess for receiving said second magnetic impeller.

6. A fluid display apparatus as in claim 5 and wherein:

a) said housing includes a pivot pin for supporting said second magnetic impeller, and b) said second magnetic impeller being rotatable on said pivot pin.

7. A fluid display apparatus as in claim 1 and wherein:

a) said perforated housing having at least one intake perforation and at least one outlet perforation.

8. A fluid display apparatus as in claim 7 and wherein;

a) said at least one outlet perforation includes an angled orifice.

9. A fluid display apparatus as in claim 1 and wherein:

a) said base includes a speed reduction drive for said motor.

10. A fluid display apparatus as in claim 9 and wherein:

a) said power source is a battery.

11. A fluid display apparatus as in claim 10 and wherein:

a) said speed reduction drive for said motor includes a variable rheostat.

12. A fluid display apparatus as in claim 1 and wherein:

a) said base is oblong and includes an outwardly extending portion, and b) said outwardly extending portion includes said on/off switch.

13. A fluid display apparatus as in claim 12 and wherein:

a) said on/off switch is positioned beyond said receptacle receiving means.

14. A fluid display apparatus as in claim 1 and wherein:

a) said receptacle receiving means includes a recess in the top of said base.

* * * * *